US005087520A

United States Patent [19]

Suzuki et al.

[11] Patent Number: 5,087,520

[45] Date of Patent: Feb. 11, 1992

[54] DURABLE HYDROPHILIC FIBERS

[75] Inventors: Masayasu Suzuki; Hisanobu Kuroda, both of Moriyama, Japan

[73] Assignee: Chisso Corporation, Ohsaka, Japan

[21] Appl. No.: 446,091

[22] Filed: Dec. 5, 1989

[30] Foreign Application Priority Data

Dec. 8, 1988 [JP] Japan ..... 63-310862

[51] Int. Cl.[5] ..... B32B 9/00; D02G 3/00

[52] U.S. Cl. ..... 428/389; 428/375; 428/379; 428/391; 428/394; 428/395

[58] Field of Search ..... 428/375, 395, 389, 379, 428/394, 391

[56] References Cited

U.S. PATENT DOCUMENTS 4,105,567 8/1978 Koerner et al. ..... 428/391

4,293,611 10/1981 Martin ..... 428/266

4,505,956 3/1985 Yamamoto et al. ..... 252/8.8

*Primary Examiner*—Lorraine T. Kendell

*Attorney, Agent, or Firm*—Fay, Sharpe, Beall, Fagan, Minnich & McKee

[57] ABSTRACT

Fibers useful as surface materials for paper diaper, napkin for menstruation, etc. are provided, which fibers comprises a polyolefin or a polyester having a mixture of (A) a fatty acid diethanolamide, (B) a polyether-modified silicone, (C) a sorbitan fatty acid ester and (D) a metal salt of an alkylsulfonate in mixing proportions of (A): 30–60%, (B): 20–55%, (C): 10–25% and (D): 5–10%, each % by weight based on the mixture, adhered onto the surface of fibers comprising a polyolefin or a polyester, in 0.2–1.0% by weight based on the fibers.

7 Claims, No Drawings

DURABLE HYDROPHILIC FIBERS

BACKGROUND OF THE INVENTION

1. Field of the Invention

This invention relates to synthetic fibers useful for coverstock of disposable diaper, sanitary napkin, etc.

2. Description of the Related Art

Disposable diaper, etc. are composed of three layers of a coverstock layer, an absorbent layer and a backing layer in the order from the side where they contact with skins at the time of wearing. For the coverstock are required not only water-permeability due to which a liquid to be absorbed is rapidly transferred to the absorbent layer, but also dry touch property affording a dry feeling to skins by preventing the backflow of the absorbed liquid. Hydrophilic properties are required for improving the water-permeability, while hydrophobic properties are required for obtaining the dry touch property In order to achieve such contrary objects, these has been proposed a non-woven fabric obtained by adhering a small quantity of a mixture of surfactants onto hydrophobic fibers of polyolefin or polyester, thereby imparting the desired hydrophilic properties (Japanese patent application laid-open Nos. Sho 63-6166/1988 and Sho 63-49158/1988).

In the case of the diaper using the coverstock made of the hydrophobic fibers having surfactants adhered thereonto as described above, when a liquid is once or twice absorbed therein, the surfactants flow out from the coverstock rapidly and water-permeability is reduced; hence when it is used for a long time, over night for example, a disagreeable sticky feeling occurs.

SUMMARY OF THE INVENTION 7 10 The present inventors have made extensive research in order to improve the above-mentioned drawbacks of conventional coverstock. As a result, we have found that when a mixture of (A) a fatty acid diethanolamide, (B) a polyether-modified silicone, (C) a sorbitan fatty acid ester and (D) a metal salt of an alkylsufonate in mixing proportions of (A): 30% to 60%, (B): 20% to 55%, (C): 10% to 25% and (D): 5% to 10%, each % by weight based on the weight of the mixture, is adhered onto the surface of fibers comprising polyolefin or polyester in 0.2% to 1.0% by weight based on the weight of the fibers, it is possible to achieve the above object, and have completed the present invention.

DETAILED DESCRIPTION OF PREFERRED EMBODIMENTS

The fibers comprising polyolefin or polyester referred to herein mean polyolefin fibers such as polyethylene composite fibers, polypropylene-ethylene-vinyl acetate copolymer composite fibers, etc., or polyester fibers such as poly(ethylene terephthalate (PET) fibers, poly(ethylene terephthalate)-poly(ethylene terephthalate-isophthalate) isophthalate copolymer composite fibers, etc. and further polyester-polyolefin composite fibers such as PETpolyethylene composite fibers.

The fatty acid diethanolamide (A), is preferably an amide of a fatty acid of 12 to 22 carbon atoms with diethanolamine, and more preferably an amide of stearic acid or oleic acid.

The polyether-modified silicone (B) is preferably a product obtained by graft-polymerizing ethylene oxide onto polydimethylsiloxane. A product having a polyether content of 40 to 60% by weight and a total molecular weight of 2,000 to 10,000 is more preferred.

The sorbitan fatty acid ester (C) is preferably an ester of sorbitan with a fatty acid of 12 to 18 carbon atoms.

Oleic acid sorbitan monoester or lauric acid sorbitan monoester is more preferred.

As the metal salt of an alkylsulfonate (D), sodium or potassium salt of sulfonic acid ester of an alkyl alcohol of 8 to 16 carbon atoms is preferable.

The respective proportions of (A), (B), (C) and (D) in the mixture are (A) 30 to 60%, (B) 20 to 55%, (C) 10 to 25%, and (D) 5 to 10%, each % by weight based on the weight of the mixture, presuming the total % by weight thereof is made 100%. If the proportion of (A) is less than 30% by weight, the durable hydrophilic properties of fibers are insufficient, while if it exceeds 60% by weight, the passableness of fibers at the spinning step or carding step is inferior. If the proportion of (B) is less than 20% by weight, the initial hydrophilic properties and durable hydrophilic properties are both insufficient, while even if it exceeds 55% by weight, the hydrophilic properties are not so much improved; hence such excess proportions are uneconomical. If the proportion of (C) is less than 10% by weight, the stability of the mixture as an oiling agent and the durable hydrophilic properties of fiber are insufficient, while if it exceeds 25% by weight, the antistatic properties of fiber become lower to cause troubles at the spinning step or the carding step. If the proportion of (D) is less than 5% by weight, the antistatic properties are insufficient, while if it exceeds 10% by weight, the durable hydrophilic properties are insufficient. Thus, the quantity of the mixture of (A), (B), (C) and (D) (hereinafter abbreviated to an oiling agent) adhered onto the above hydrophobic fibers is 0.2 to 1.0% by weight, preferably 0.3% to 0.6% by weight based on the weight of the fibers. If its quantity adhered is less than 0.2% by weight, the initial hydrophilic properties, durable hydrophilic properties and antistatic properties are insufficient, while if it exceeds 1.0% by weight, there occur such problems that the fibers are liable to cling onto the cylinder at the carding step, and the coverstock made of such fibers gives a sticky feeling to make the touch inferior; etc.

The process of adhering the mixture of these surfactants onto hydrophobic fibers has no particular limitation, and conventional processes may be employed such as those of using oiling rolls at the spinning step; spray process or immersion process after the fibers have been made up into a web or non-woven fabric; etc.

The durable hydrophilic fibers of the present invention are superior in the initial hydrophilic properties and durable hydrophilic properties and afford a good skin touch without any sticky feeling; hence when they are processed and used as a coverstock for disposable diaper, etc., it is possible to obtain a product having an absorptivity which does not lower even after its long time use, and a good skin touch. As to the process of producing the above surface material with the durable hydrophilic fibers of the present invention, any conventional process for producing non-woven fabric may be utilized such as a process of making up the fibers into a web having a desired basis weight by means of a card, etc., followed by a needle-punching process or a heating rolls process making a non-woven fabric.

The present invention will be described in more detail by way of Examples and Comparative examples, but it should not be construed to be limited thereto. In these Examples and Comparative examples, the following methods were employed for evaluating the physical properties:

Stability of Oiling Agent

The surfactant mixture (oiling agent) is dissolved in water to prepare a 10% solution, followed by allowing it to stand at room temperature for 24 hours.

An oiling agent which is easily soluble and contains no insoluble (having a good solubility) and forms no phase separation or deposited substance (having a good solution stability) is expressed by a symbol A; an oiling agent which is insufficient in either one of the above two properties is expressed by a symbol B; and an oiling agent which is insufficient in both of the above two properties is expressed by a symbol C.

Antistatic Properties

Staple fibers of sample are made up into a web by means of a card under conditions of 20° C. and a relative humidity of 45%, followed by measuring the voltage of static electricity generated in the web and evaluated under the following standards:

A—<50V; A-B—<100V,
B—<500V; C—500V.

Card-Passing Properties

Staple fibers of sample (40 g) are carded by means of a testing card machine under conditions of 30° C. and a relative humidity of 80% and at a passing rate of 7 m/min., followed by observing the fibers clinging on the cylinder of the card and evaluated under the following standards:

A—no cling; B—partially clinged;
C—entirely clinged

Hydrophilic Properties of Fibers

Staple fibers of sample (5 g) carded by passing through a card are packed in a copper wire basket of 3 cm in diameter, 8 cm long and 3 g in weight, followed by softly place the basket on the water surface of a tank at a water temperature of 25° C. Then the period elapsed until the sample together with the basket sunk in water is measured. The sample having sunk is immediately taken out of water, followed by dehydration by a centrifuge, dryed at 50° C. for one hour and repeating the same procedure as the above to measure the period until sinking. The measurement is repeated for 5 times. In the case the period until sinking is shorter than 10 seconds, the hydrophilic properties are judged to be good, and in the case the value of the fifth measurement, too, is shorter than 10 seconds, the durable hydrophilic properties is judged to be good.

Initial Hydrophilic Properties of Non-Woven Fabric

A non-woven fabric having a basis weight of about 30 g/m$^2$ is prepared using a web obtained by carding staple fiber of sample. This non-woven fabric is placed on a filter paper (No. 50 made by Toyo Filter Paper Co., Ltd.). Then one drop (about 0.05 ml) of water is dropped onto the surface of the non-woven fabric from a barrette having its tip end set at a height of 1 cm above the surface thereof, and the period of time which elapsed until the water drop on the surface of the non-woven fabric disappeared is measured. This measurement is carried out at 20 points on the surface of the non-woven fabric and the number of points where the said elapsed time is less than 3 seconds is listed. When the number of points is 18 or more, the initial hydrophilic properties are regarded as good.

Durable Hydrophilic Properties of Non-woven Fabric

A non-woven fabric (10 cm×10 cm) prepared by the abovementioned process is placed on a commercially available paper diaper. A cylinder of 6 cm in inner diameter is placed on the non-woven fabric. Then water (65 ml) is poured in the cylinder so as to be absorbed into the paper diaper through the non-woven fabric. The materials are allowed to stand for 3 minutes after the water pouring. Then the non-woven fabric is placed between two dry filter papers (No. 50, made by Toyo Filter Paper Co., Ltd.). A plate (10 cm×10 cm) of a weight of 3.5 kg in total is placed on these materials to stand for 3 minutes to dehydrate the non-woven fabric. After air-drying of the non-woven fabric for 5 minutes, with the portion of the non-woven fabric wetted with water within the inner diameter of the cylinder, the disappearing period of water drop is measured at 20 points inside the portion, according to the above-mentioned testing method of the initial hydrophilic properties of the non-woven fabric. The number of points less than 3 seconds are listed. When the number is 18 or more, the fabric was regarded as good in durable hydrophilic properties.

Skin Touch

The skin touch of the non-woven fabric of sample is judged according to an organoleptic test by 5 panelers, the fabric judged by 5 panelers to have a smooth touch without any sticking feeling was expressed by "A"; the fabric judged by two or less panalers to have a sticky feeling or an unagreeable feeling is expressed by "B"; and the fabric judged by three or more panelers to have a sticky feeling is expressed by "C".

EXAMPLE 1-5 AND COMPARATIVE EXAMPLES 1-17

At the spinning step of sheath and core type composite fibers composed of polypropylene as a core component and polyethylene as a sheath component (composite ration: 50/50), surfactant mixtures as oiling agents having various compositions shown in Table 1 were adhered, followed by stretching and cutting to obtain staple fibers having a single fiber fineness of 2 denirs and a fiber length of 51 mm. The respective staple fibers were made up into a carded web, followed by heat treatment by means of a suction dryer (140° C.) to obtain a non-woven fabric having a basis weight of about 30 g/m$^2$. The physical properties of the above surfactant mixtures, staple fibers and non-woven fabrics are listed in Table 1.

TABLE 1 (1)

| | Ex. 1 | Ex. 2 | Ex. 3 | Ex. 4 | Ex. 5 | Comp. ex. 1 | Comp. ex. 2 | Comp. ex. 3 | Comp. ex. 4 | Comp. ex. 5 | Comp. ex. 6 |
|---|---|---|---|---|---|---|---|---|---|---|---|
| Oiling agent Proportions of components | | | | | | | | | | | |
| Stearic acid diethanolamide | 50 | 40 | 60 | 40 | 30 | 50 | 50 | 30 | 50 | 30 | 30 |
| Polyether-modified silicone (EO-modified) | 30 | 40 | 20 | 25 | 55 | 30 | 30 | 70 | 30 | 50 | 30 |

TABLE 1 (1)-continued

| | Ex. 1 | Ex. 2 | Ex. 3 | Ex. 4 | Ex. 5 | Comp. ex. 1 | Comp. ex. 2 | Comp. ex. 3 | Comp. ex. 4 | Comp. ex. 5 | Comp. ex. 6 |
|---|---|---|---|---|---|---|---|---|---|---|---|
| Polyether-modified silicone (PO/EO-modified) | | | | | | | | | | | |
| Sorbitan monooleate | 15 | 10 | 15 | 25 | 10 | 15 | 15 | | 20 | 20 | 40 |
| Na salt of alkyl($C_{14}$–$C_{18}$) sulfonate | 5 | 10 | 5 | 10 | 5 | 5 | 5 | | | | |
| POE(20) sorbitan monofatty acid ester | | | | | | | | | | | |
| PEG(400) fatty acid ester | | | | | | | | | | | |
| K salt of alkyl($C_8$–$C_{12}$) phosphate | | | | | | | | | | | |
| Adhered quantity (%) | 0.4 | 0.4 | 0.4 | 0.4 | 0.4 | 0.1 | 0.3 | 0.4 | 0.4 | 0.4 | 0.4 |
| Stability of oiling agent | A | A | A | A | A | A | A | B | B | B | B |
| Fibers | | | | | | | | | | | |
| Spinning Properties | | | | | | | | | | | |
| Antistatic properties | A | A | A | A | A | C | A | A-B | A-B | A-B | B |
| Card-passing properties | A | A | A | A | A | A | C | A | A | A | B |
| Sinking rate of raw cotton (sec) | | | | | | | | | | | |
| 1st (times) | 3.8 | 2.3 | 3.9 | 3.6 | 2.5 | 17.3 | 2.0 | 2.1 | 3.7 | 3.0 | 6.9 |
| 2nd | 4.9 | 5.0 | 4.5 | 4.7 | 4.1 | 39.8 | 2.8 | 3.9 | 4.4 | 4.0 | 8.6 |
| 3rd | 5.5 | 5.3 | 5.2 | 5.8 | 6.6 | — | 3.8 | 5.0 | 5.4 | 5.2 | 11.4 |
| 4th | 6.8 | 6.2 | 7.0 | 6.4 | 6.9 | — | 4.2 | 5.9 | 5.7 | 5.7 | 42.5 |
| 5th | 6.7 | 6.9 | 7.2 | 6.6 | 7.5 | — | 4.9 | 7.4 | 6.0 | 6.1 | — |
| Non-woven fabric | | | | | | | | | | | |
| Basis weight of non-woven fabric (g/m$^2$) | 30.3 | 29.8 | 31.0 | 31.2 | 30.1 | 30.5 | 30.0 | 30.8 | 29.5 | 30.4 | 30.9 |
| Initial hydrophilic properties (20 points(full mark)) | 20 | 20 | 20 | 20 | 20 | 5 | 20 | 20 | 20 | 20 | 16 |
| Durable hydrophilic properties (20 points (full mark)) | 20 | 20 | 19 | 20 | 18 | 0 | 20 | 18 | 19 | 20 | 11 |
| Touch | A | A | A | A | A | A | C | A | A | A | A |

TABLE 1 (2)

| | Comp. ex. 7 | Comp. ex. 8 | Comp. ex. 9 | Comp. ex. 10 | Comp. ex. 11 | Comp. ex. 12 | Comp. ex. 13 | Comp. ex. 14 | Comp. ex. 15 | Comp. ex. 16 | Comp. ex. 17 |
|---|---|---|---|---|---|---|---|---|---|---|---|
| Oiling agent | | | | | | | | | | | |
| Proportions of components | | | | | | | | | | | |
| Stearic acid diethanolamide | 50 | 50 | 50 | 50 | 50 | 50 | 60 | 20 | 50 | 40 | 65 |
| Polyether-modified silicone (EO-modified) | 30 | 30 | 30 | | 30 | 35 | 10 | 55 | 20 | 25 | 20 |
| Polyether-modified silicone (PO/EO-modified) | | | | 30 | | | | | | | |
| Sorbitan monooleate | | | 10 | 15 | 17 | 5 | 25 | 15 | 15 | 30 | 10 |
| Na salt of alkyl($C_{14}$–$C_{18}$) sulfonate | | | | 5 | 3 | 10 | 5 | 10 | 15 | 5 | 5 |
| POE(20) sorbitan monofatty acid ester | 20 | | | | | | | | | | |
| PEG(400) fatty acid ester | | 20 | | | | | | | | | |
| K salt of alkyl($C_8$–$C_{12}$) phosphate | | | 10 | | | | | | | | |
| Adhered quantity (%) | 0.4 | 0.4 | 0.4 | 0.4 | 0.4 | 0.4 | 0.4 | 0.4 | 0.4 | 0.4 | 0.4 |
| Stability of oiling agent | B | B | C | A | B | B | B | A | A | B | B |
| Fibers | | | | | | | | | | | |
| Spinning Properties | | | | | | | | | | | |
| Antistatic properties | A | B | B | B | A-B | A | A | A | A | A-B | A |
| Card-passing properties | A | A | A | A | A | A | A | A | A | A | A |
| Sinking rate of raw cotton (sec) | | | | | | | | | | | |
| 1st (times) | 3.1 | 4.0 | 7.1 | 3.4 | 3.3 | 3.6 | 13.7 | 3.0 | 3.8 | 4.1 | 4.3 |
| 2nd | 19.8 | 7.9 | 15.6 | 12.7 | 4.8 | 5.0 | 28.8 | 8.2 | 8.0 | 5.3 | 6.0 |
| 3rd | — | 11.3 | 27.0 | 50.6 | 5.6 | 5.8 | 39.2 | 24.4 | 12.2 | 5.6 | 7.1 |
| 4th | — | 49.6 | — | — | 6.3 | 5.8 | — | 51.1 | 38.3 | 6.3 | 7.2 |
| 5th | — | — | — | — | 6.9 | 7.0 | — | — | — | 6.7 | 7.5 |
| Non-woven fabric | | | | | | | | | | | |
| Basis weight of non-woven fabric (g/m$^2$) | 28.9 | 31.1 | 30.2 | 30.2 | 32.5 | 33.0 | 31.8 | 29.5 | 30.6 | 28.8 | 32.2 |
| Initial hydrophilic properties (20 points (full mark)) | 20 | 18 | 12 | 20 | 20 | 20 | 8 | 20 | 19 | 19 | 19 |
| Durable hydrophilic properties (20 points (full mark)) | 0 | 6 | 4 | 0 | 20 | 19 | 2 | 12 | 7 | 18 | 18 |
| Touch | A | A | A | A | A | A | A | A | A | A | A |

As apparent from the data shown in Table 1, the hydrophobic fibers using the surfactants of the proportions disclosed in the present invention provide a non-woven fabric having superior initial hydrophilic properties and durable hydrophilic properties as well as a good skin touch. They are useful as coverstock of disposable diaper etc.

What we claim is:

1. Coated fibers comprising polyolefin or polyester fibers having adhered onto the surface thereof from about 0.2 to about 1.0% by weight of an oiling agent based on the weight of said fibers, wherein said oiling agent comprises a mixture of (A) from about 30% to about 60% by weight of a fatty acid diethanolamide, (B) from about 20% to about 55% by weight of a polyether-modified silicone, (C) from about 10% to about 25% by weight of a sorbitan fatty acid ester and (D) from about 5% to about 10% by weight of a metal salt of an alkylsulfonate, each said % by weight based on the weight of said mixture.

2. Coated fibers according to claim 1, wherein said polyolefin or said polyester fibers are selected from the group consisting of polyethylene fibers, polypropylene fibers, polypropylene-polyethylene composite fibers, poly(ethylene terephthalate) fibers, poly(ethylene terephthalate)-poly(ethylene terephthalate-isophthalate) copolymer composite fibers, and polyester-polyolefin composite fibers.

3. Coated fibers according to claim 1, wherein said fatty acid diethanolamid is an amide of a fatty acid of 12 to 22 carbon atoms with diethanol amine.

4. Coated fibers according to claim 1, wherein said polyether-modified silicone is a product obtained by graft-polymerizing ethylene oxide onto polydimethylsiloxane and having a polyester content of 40% to 60% by weight and a total molecular weight of 2,000 to 10,000.

5. Coated fibers according to claim 1, wherein said sorbitan fatty acid ester is an ester of sorbitan with a fatty acid of 12 to 18 carbon atoms.

6. Fibers according to claim 1, wherein said metal salt of an alkylsulfonate is a sodium or potassium salt of sulfonic acid ester of an alkyl alcohol of 8 to 16 carbon atoms.

7. Coated fibers according to claim 1, wherein said oiling agent is adhered onto said fibers in 0.3% to 0.6% by weight based on the weight of fibers.

* * * * *